US006799579B2

(12) United States Patent
Joseph

(10) Patent No.: US 6,799,579 B2
(45) Date of Patent: Oct. 5, 2004

(54) FINGERNAIL AND TOENAIL SHAPING APPARATUS

(76) Inventor: James R. Joseph, 6497 College Ave., SE., Kentwood, MI (US) 49548

( * ) Notice: Subject to any disclaimer, the term of this patent is extended or adjusted under 35 U.S.C. 154(b) by 0 days.

(21) Appl. No.: 10/353,348

(22) Filed: Jan. 29, 2003

(65) Prior Publication Data

US 2004/0144398 A1 Jul. 29, 2004

(51) Int. Cl.[7] ..... A45D 29/20
(52) U.S. Cl. ..... 132/73.6; 132/76.2
(58) Field of Search ..... 132/73.6, 75.6, 132/76.4, 76.5; 451/297, 311, 296, 355, 65, 67, 73, 71, 461, 303, 357; 173/29; 403/349, 348

(56) References Cited

U.S. PATENT DOCUMENTS

| | | | | |
|---|---|---|---|---|
| 1,482,837 | A | | 2/1924 | Buck |
| 2,258,012 | A | | 10/1941 | Jeannotte |
| 2,389,665 | A | | 11/1945 | Harris |
| 2,423,737 | A | | 7/1947 | Tavano |
| 2,560,102 | A | | 7/1951 | Guinn |
| 2,819,565 | A | | 1/1958 | Werth |
| 2,976,652 | A | | 3/1961 | Bedortha et al. |
| 3,126,021 | A | | 3/1964 | May |
| 3,619,949 | A | | 11/1971 | Welsch et al. |
| 3,713,255 | A | | 1/1973 | Welsch |
| 3,754,556 | A | | 8/1973 | Watkins |
| 3,823,513 | A | | 7/1974 | Welsch |
| 3,913,594 | A | | 10/1975 | Tsukamoto |
| 4,016,890 | A | | 4/1977 | Fiorenza, Sr. et al. |
| 4,103,694 | A | | 8/1978 | Burian et al. |
| 4,117,854 | A | | 10/1978 | Rosenbloom |
| 4,137,926 | A | | 2/1979 | Pao |
| 4,213,471 | A | | 7/1980 | Burian et al. |
| 4,316,349 | A | | 2/1982 | Nelson |
| 4,368,597 | A | | 1/1983 | Fleckenstein |
| 4,411,106 | A | | 10/1983 | Fleckenstein et al. |
| 4,440,182 | A | | 4/1984 | Holm |
| 4,478,232 | A | | 10/1984 | Yasuda |
| 4,683,897 | A | | 8/1987 | McBride |
| 4,753,253 | A | | 6/1988 | Hutson |
| 4,773,788 | A | * | 9/1988 | Ruhl ..... 403/24 |
| 4,858,390 | A | | 8/1989 | Kenig |
| 4,924,578 | A | | 5/1990 | Chagnon et al. |
| 5,033,552 | A | | 7/1991 | Hu |
| 5,161,552 | A | | 11/1992 | Kathuria |
| 5,168,658 | A | | 12/1992 | Price |
| 5,643,062 | A | | 7/1997 | Joseph et al. |
| 5,887,598 | A | * | 3/1999 | Oliver et al. ..... 132/73.6 |
| 6,179,696 | B1 | * | 1/2001 | Duffy ..... 451/357 |
| 6,217,248 | B1 | * | 4/2001 | Reiff ..... 403/24 |

* cited by examiner

*Primary Examiner*—Todd E. Manahan
(74) *Attorney, Agent, or Firm*—Price, Heneveld, Cooper, DeWitt & Litton

(57) ABSTRACT

A belt cartridge that is releasably attachable to a manicuring machine having a drive roller that is insertable into the belt cartridge for engagement of the drive roller with flexible belt contained in the cartridge includes a retainer for holding the flexible belt in close proximity to a predefined circuitous path when the cartridge is not installed on the manicuring machine. The retainer eliminates any need for manipulating the flexible belt before or during attachment of the cartridge to the manicuring machine. A protuberance on the back wall of the cartridge is provided for engagement with a recess in a mounting face of the manicuring machine to inhibit movement of the cartridge with respect to the manicuring machine. This engagement between the protuberance and the recess locks the cartridge onto the manicuring machine during normal use without the need for a separately actuated locking pin.

2 Claims, 3 Drawing Sheets

FINGERNAIL AND TOENAIL SHAPING APPARATUS

FIELD OF THE INVENTION

This invention relates to a fingernail and toenail shaping apparatus and more particularly to an improved abrasive belt cartridge that is removably attachable to a manicuring machine.

BACKGROUND OF THE INVENTION

A fingernail and toenail shaping apparatus having a detachable and disposable belt cartridge is disclosed in U.S. Pat. No. 5,643,062, issued to the inventor James R. Joseph, the entire contents of which are hereby incorporated herein by reference. The cartridges can be easily replaced to facilitate course grinding, fine grinding, buffing, etc. Further, the use of easily interchangeable cartridges facilitates and promotes replacement of the cartridge whenever the machine is being used to file or buff fingernails and toenails of a different person, whereby better hygiene is achieved.

The cartridge is easily attached to and removed from a gear reduction module. In one embodiment, the belt cartridge is provided with a drive roller and an aperture through which a drive shaft extends into a keyed opening or socket of the drive roller to provide engagement between a drive shaft attached to the gear reduction module and the drive roller contained in the cartridge. Idler rollers and a tensioner having integrally formed spring portions with arcuate bearing surfaces at opposite ends of the tensioner define a circuitous belt path. The abrasive surface of the belt is available for fingernail and toenail shaping through an opening in the cartridge that extends generally between the idler rollers. Attachment of this embodiment of the cartridge to the gear reduction module is relatively easy. Attachment is achieved by aligning pins on the gear reduction module with slots on the back of the cartridge, inserting the pins into the slots, sliding the cartridge downwardly relative to the gear reduction module, and sliding a locking pin on the gear reduction module into engagement with the cartridge. However, a disadvantage of this embodiment, as disclosed in the patent, is that the provision of a drive roller in the cartridge increases the cost of manufacturing the cartridge. The idler rollers may be manufactured relatively inexpensively from thermoplastic materials. However, in order to achieve adequate frictional engagement between the drive roller and the inner surface of the abrasive belt and suitable mechanical coupling between a drive shaft and the drive roller, the drive roller generally comprises a metal hub onto which is mounted an elastomeric wheel or roller. Accordingly, the drive roller is relatively expensive to manufacture, such that it is more desirable to provide the drive roller on the manicuring machine, rather than in the cartridge.

In an alternative, more preferred, embodiment, a drive roller is secured to the drive shaft of the manicure machine, eliminating the need for a drive roller in the cartridge, thereby reducing the cost of the cartridge. In this embodiment, the cartridge is provided with an opening through which the drive roller attached to the manicuring machine extends into the belt cartridge to engage in inner surface of an abrasive belt contained within the cartridge. Although elimination of the drive roller from the cartridge provides a considerable cost savings, the abrasive belt of this embodiment can slip out of proper position after it is manufactured and/or after it is detached from the manicuring machine. When this occurs, the belt can obstruct the opening for the drive roller. To prevent damage to the abrasive belt and to achieve proper engagement between the abrasive belt and the drive roller, it is often necessary to carefully reposition the abrasive belt within the cartridge before and/or during attachment of the cartridge to the manicuring machine. This can be a cumbersome task that creates a perception of inconvenience, which could adversely affect market appeal for the product.

It would be desirable to provide a belt cartridge which is easily attachable to a manicuring machine, and which does not contain a drive roller. In other words, there is a need for a disposable belt cartridge for a fingernail and toenail apparatus that achieves the easy attachability of a belt cartridge containing a drive roller, while eliminating the drive roller from the belt cartridge to achieve a cost advantage.

A cartridge of U.S. Pat. No. 5,643,062 is attached to the gear reduction module of the manicure machine by aligning pins on the gear reduction module with keyhole-shaped slots in the back wall of the cartridge, pushing the pins into circular portions of the slots, sliding the cartridge relative to the gear reduction module, and then sliding a locking pin on the gear reduction unit toward the cartridge to engage a notch in the cartridge, whereby the cartridge is locked into proper position to prevent the cartridge from moving with respect to the gear reduction module and maintain the appropriate tension on the abrasive belt.

It would be desirable to simplify attachment of the cartridge to the manicuring machine. More specifically, there is a need for a belt cartridge which may be easily and securely attached to a manicuring machine without having to manipulate the abrasive bell during attachment of the cartridge to the machine, and which can be maintained in an appropriate locked position without performing a separate step of sliding a locking pin into the cartridge.

SUMMARY OF THE INVENTION

In accordance with a first aspect of the invention, a belt cartridge that is releasably attachable to a manicuring machine having a drive roller that is insertable into the belt cartridge for engagement of the drive roller with a flexible belt contained in the cartridge includes a retainer for holding the flexible belt in close proximity to a predefined circuitous path when the cartridge is not installed on the manicuring machine. The cartridge is defined by a easing having a front wall and a back wall. A flexible belt is disposed in the casing. The flexible belt has an abrasive outer surface for shaping fingernails and toenails and an inner surface for engaging a drive roller. The belt cartridge includes a first idler roller or bearing surface mounted in the casing for guiding the flexible belt around the circuitous path, and a second idler roller or bearing surface mounted in the casing for guiding the flexible belt around the circuitous path. When the cartridge is mounted onto the manicuring machine, the circuitous path is generally defined by the drive roller on the manicuring machine, and by the first and second idler rollers or bearing surfaces. An opening through the back wall of the casing allows insertion of the drive roller into engagement with the inner surface of the flexible belt. A first arcuate ridge projects from an inner surface of the front wall of the casing, and an opposing second arcuate ridge projects from an interior surface of the back wall of the casing. The opposing first and second arcuate ridges together define a retainer for holding the flexible belt in close proximity to the predetermined circuitous path when a drive roller is not inserted into the casing, i.e., when the cartridge is not attached to the manicuring machine. The retainer eliminates any need for manipulating the flexible belt before or during attachment of the cartridge to the manicuring machine or after removal of the cartridge from the manicuring machine.

In accordance with another aspect of the invention, a belt cartridge that is releasably attachable to a manicuring machine having a drive roller that is insertable into the belt cartridge for engagement of the drive roller with a flexible belt contained in the cartridge is configured to be securely mounted on the manicuring machine without the need for a locking pin. The belt cartridge includes a casing having a front wall and a back wall. A flexible belt is contained in the casing. The flexible belt includes an abrasive outer surface for shaping fingernails and toenails and an inner surface for engaging a drive roller. A first idler roller or bearing surface is mounted in the casing for guiding the flexible belt around a predefined circuitous path, and a second idler roller or bearing surface is mounted in the casing for guiding the flexible belt around the circuitous path. An opening through the back wall of the casing is provided to allow insertion of a drive roller into engagement with the inner surface of the flexible belt. At least one fastener slot through the back wall of the casing is provided for engagement with a fastener projecting from a cartridge mounting face on the manicuring machine. A protuberance on the back wall of the cartridge is provided for engagement with a recess in the mounting face of the manicuring machine to inhibit movement of the cartridge with respect to the manicuring machine. This engagement between the protuberance on the cartridge and the recess on the manicuring machine locks the cartridge onto the manicuring machine during normal use without the need for a separately actuated locking pin.

These and other features, advantages and objects of the present invention will be further understood and appreciated by those skilled in the art by reference to the following specification, claims and appended drawings.

DESCRIPTION OF THE PREFERRED EMBODIMENTS

Figure 1:
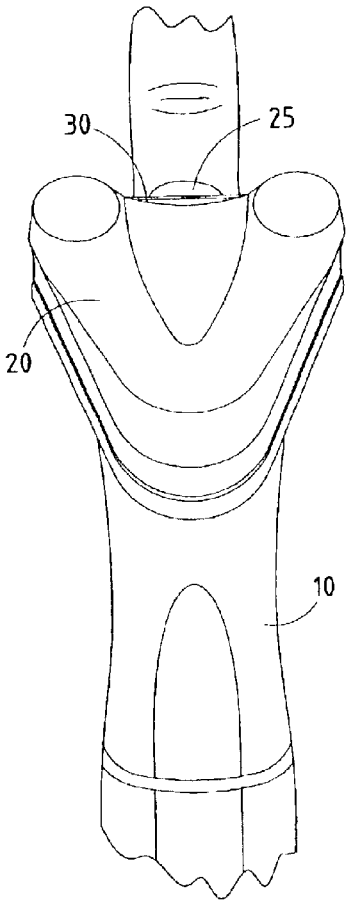
FIG. 1 is a top view of a manicuring machine with a belt cartridge mounted on the manicuring machine and with the flexible belt of the belt cartridge contacting a fingernail for shaping and/or buffing the fingernail.
Figure 2:
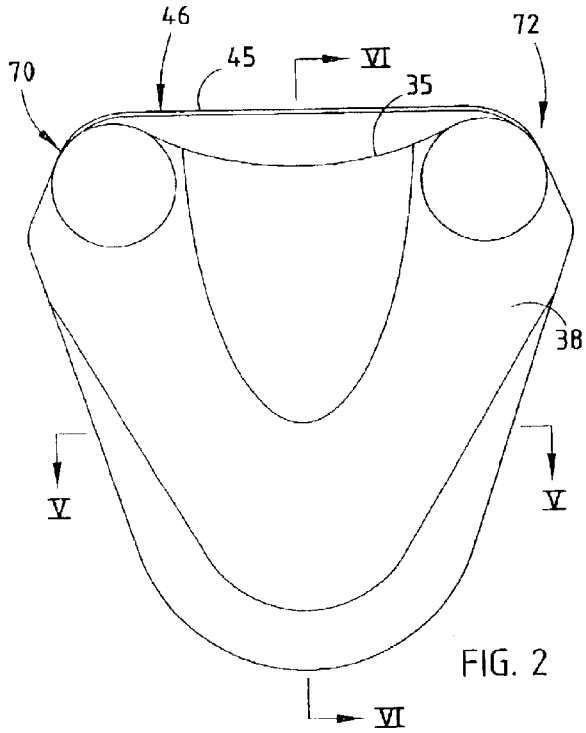
FIG. 2 is a front elevational view of the belt cartridge shown in FIG. 1.

Shown in FIG. 1 is a manicuring machine 10 with a flexible belt cartridge 20 releasably attached to the manicuring machine 10. The manicuring machine 10 is shown being used for buffing a fingernail 25. Manicuring machine 10 may be any device having a drive roller engageable with a flexible belt 30 contained within the cartridge 20, and which is configured to releasably but securely receive the cartridge 20.

In the illustrated embodiment, cartridge 20 comprises a casing defined by a front casing member 35 having a front wall 38 (FIGS. 2 and 4–7), and a back casing member 40 defining a back wall 42 (FIGS. 3–7). As shown in FIGS. 4–7, front casing member 35 and back easing member 40 are joined together to define a hollow casing for containing a flexible belt 45. Casing members 35 and 40 may be joined together by employing conventional ultrasonic welding techniques, adhesives, snap together features, one piece molding technique, or the like.

Figure 3:
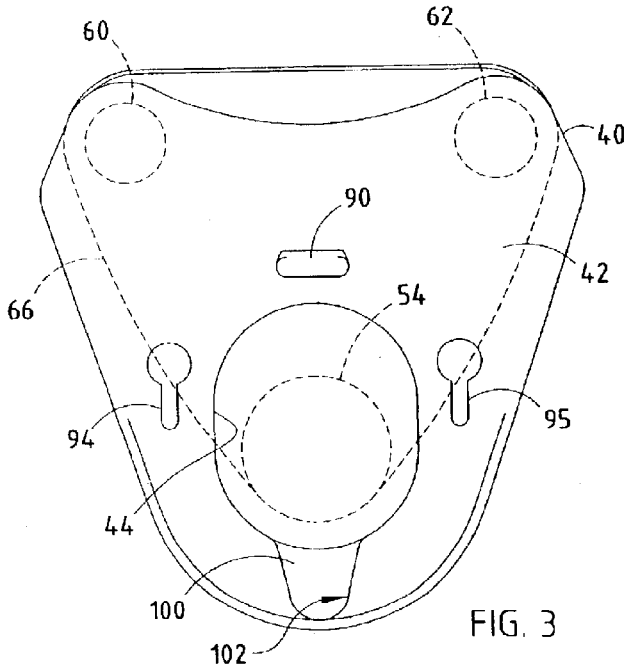
FIG. 3 is a rear view of the cartridge shown in FIG. 1.
Figure 4:
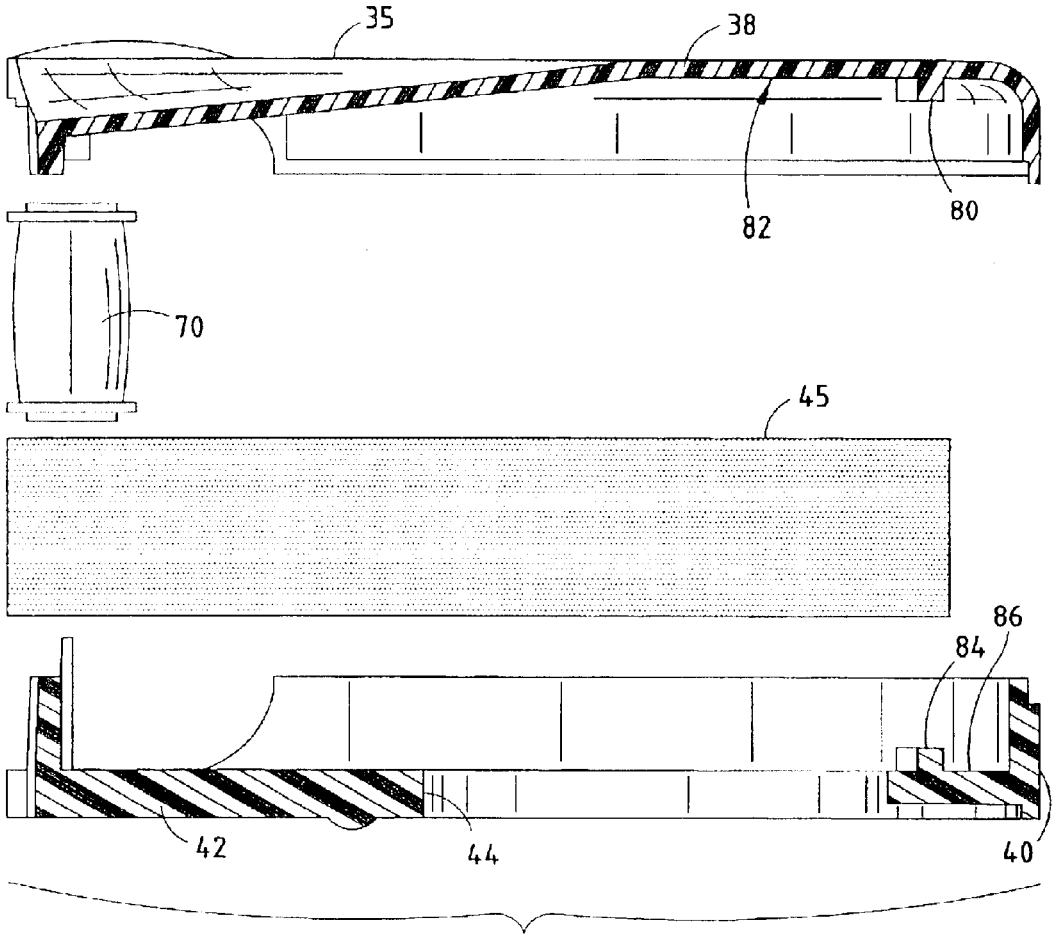
FIG. 4 is an exploded cross-sectional view of the belt cartridge, as seen along view lines IV—IV of FIG. 2.
Figure 5:
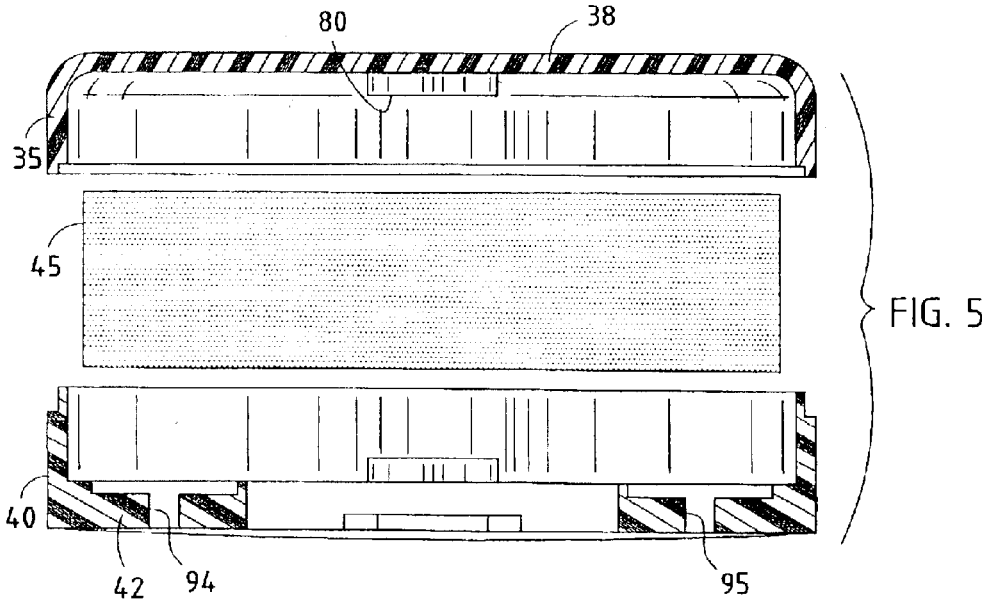
FIG. 5 is an exploded cross-sectional view of the belt cartridge as seen along view lines V—V of FIG. 2.

As shown in FIG. 3, back casing member 40 includes an opening or aperture 44 through which a drive roller 50 (FIGS. 6 and 7) is inserted for engagement with belt 45. Flexible belt 45 includes an abrasive outer surface 46, for shaping (e.g., buffing, grinding or filing) fingernails and toenails, and an inner surface 47 for engaging drive roller 50 (as shown in FIG. 7). Shown in dashed lines in FIG. 3 are the approximate locations 60 and 62 of idler rollers 70 (FIGS. 6 and 7) or arcuate bearing surfaces mounted in the casing defined by casing members 35 and 40, which together with a drive roller having a location indicated by dashed lines 64, define a circuitous path (indicated by dashed line 66) for flexible belt 45. An example of suitable idler rollers and/or arcuate bearing surfaces for use in defining a circuitous path for flexible belt 45 are described in U.S. Pat. No. 5,643,062, which has been incorporated herein by reference.

Openings 70 and 72 (FIG. 2) are provided at the bottom of the casing defined by members 35 and 40 to allow exposure of the abrasive surface 46 of flexible belt 45 between the first idler roller 70 or arcuate bearing surface and the second idler roller 70 or arcuate bearing surface.

As shown in FIGS. 4–7, front casing member 35 defines a first arcuate ridge 80 that projects from an interior surface 82 of front wall 38 of the casing. An opposing second acurate ridge 84 projects from an interior surface 86 of the back wall 42 of the casing. The opposing first and second arcuate ridges 80 and 84 together define a retainer for holding the flexible belt 45 in close proximity to the predetermined circuitous path when a drive roller is not inserted into the casing, i.e., before the belt cartridge 20 has been attached to the manicuring machine 10 or after the belt cartridge 20 has been removed from the manicuring machine 10.

Figure 6:
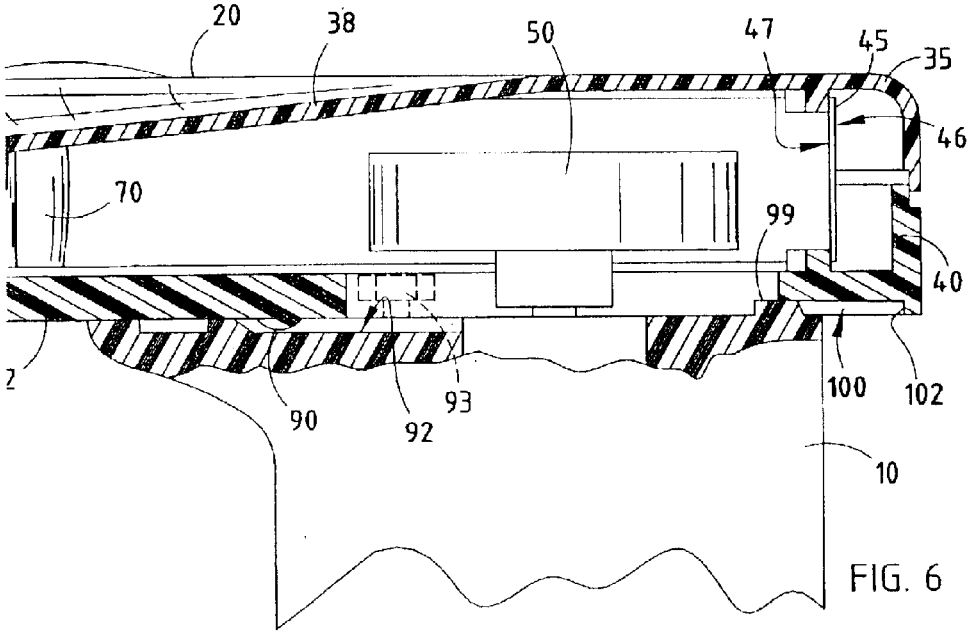
FIG. 6 is a cross-sectional view of the belt cartridge in a pre-mounting position on a manicuring machine.
Figure 7:
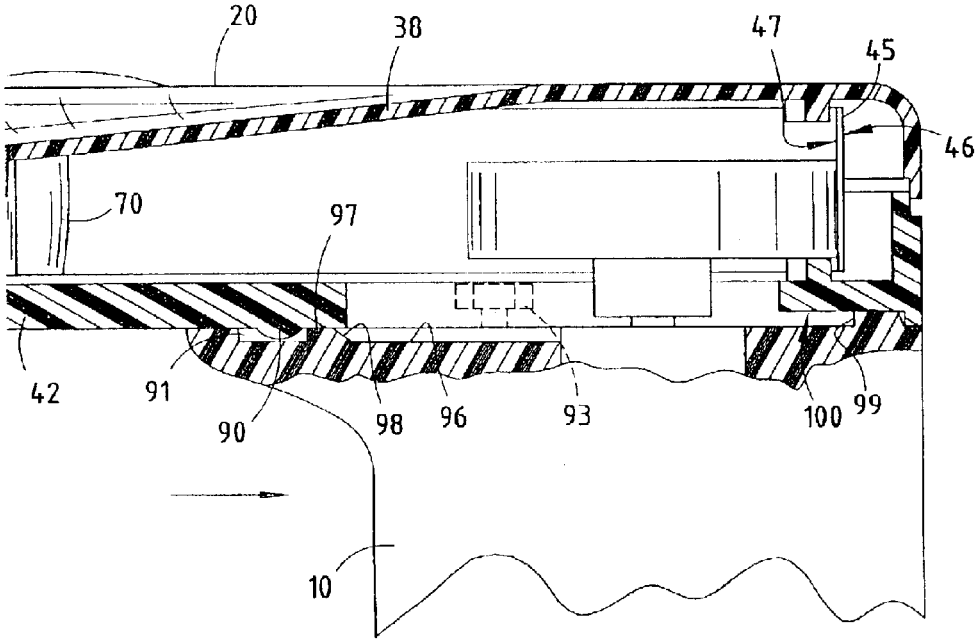
FIG. 7 is a cross-sectional view of the belt cartridge in a mounted or locked position on a manicuring machine.

As shown in FIGS. 6 and 7, a protuberance 90 on the exterior surface of back wall 42 of cartridge 20 is provided for engagement with a recess 91 in a cartridge mounting face 92 of manicuring machine 10 to inhibit movement of cartridge 20 with respect to manicuring machine 10. Fasteners 93 (only one of which is shown in FIGS. 6 and 7) project from cartridge mounting face 92 for engagement with fastener slots 94 and 95 (FIGS. 3 and 5) which extend through back wall 42 of the casing defined by casing members 35 and 40. Fasteners 93 are configured to cooperate with fastener slots 94 and 95 to hold the back wall 42 of cartridge 20 in abutment with cartridge mounting face 92 of manicuring machine 10. In the illustrated embodiment, fastener 93 includes a reduced diameter shank portion and an enlarged diameter head portion. Fastener slots 94 and 95 are shaped to allow the stud portion or head of fastener 93 to be inserted through a circular section of the slots when cartridge 20 is positioned in a pre-mounting orientation with respect to manicuring machine 10 as shown in FIG. 6. Slots 94 and 95 also have a narrow section having a width about equal to or slightly greater than the diameter of the shank portion of the fasteners and substantially less than the diameter of the head portion of the fasteners, such that engagement between fasteners 93 and slots 94 and 95 holds cartridge 20 on manicuring machine 10 when cartridge 20 is moved from the premounting position shown in FIG. 6 to the locked position shown in FIG. 7.

An indentation 96 is defined in cartridge mounting face 92 of manicuring machine 10. Indentation 96 is spaced from recess 91. The spacing between indentation 96 and recess 91 defines a plateau 97. A ramped side wall 98 extends from a bottom of indentation 96 to plateau 97. During attachment of cartridge 20 to manicuring machine 10, protuberance 90 is first received in indentation 96 as shown in FIG. 6 when the cartridge 20 is in a pre-mounting position with respect to manicuring machine 10. Thereafter, cartridge 20 is urged with respect to manicuring machine 10 into the locked position shown in FIG. 7. During this time, protuberance 90 engages ramp 98. At the top of the ramp, engagement between protuberance 90 and plateau 97 causes elastic deformation of the cartridge casing until protuberance 90 is snapped into the recess 91 as shown in FIG. 7. Accordingly, ramped indentation 96 cooperates with protuberance 90 to provide a snap-on and snap-off relationship between cartridge 20 and manicuring machine 10.

A boss 99 projects from cartridge mounting face 92 of manicuring machine 10. Boss 99 is slideable along a recess 100 that extends away from opening 44 of back casing member 40. Boss 99 is engageable with a side wall 102 of recess 100 when belt cartridge 20 is slid from the premounting position shown in FIG. 6 into the locked position shown in FIG. 7. Engagement of protuberance 90 with recess 91 combined with engagement of boss 99 with cartridge recess 100 cooperatively inhibits movement of bell cartridge 20 with respect to manicuring machine 10. Together, these interactions prevent unintended movement of cartridge 20 with respect to manicuring machine 10 during normal use, without requiring a slideable locking pin.

Cartridge 20 is designed with an arcuate platen 120 to limit the tension of the abrasive belt when pressed over the surface of a human fingernail. If the operator applies too much force, then arcuate platen 120 restricts the tension of belt 45 causing it to slip against drive roller 50 instead of causing potential damage to the nail bed. Sometimes however it is desirable to purposely apply added pressure to the nail surface such as when removing a heavy build-up of acrylic material or to shorten length off the front of the fingernail. In such cases it is undesirable to limit the tension of the abrasive belt or to allow the abrasive belt to slip against the drive roller. To achieve extra tension in an abrasive belt cartridge that has no tensioning apparatus other than the elastomeric material mounted to the drive roller hub, the length of the abrasive belt, and the cartridge's position on the gear head, it is necessary to manually push the top of cartridge 20 in a downward direction which in turn creates extra tension on inner surface 47 of the abrasive belt 45. The narrow portion of key-hole slots 94, 95 located on the back portion of cartridge 20 have been designed with slightly additional length, allowing cartridge 20 to move downward when pressed upon to achieve additional tension against inner surface 47 of abrasive belt 45.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A belt cartridge that is releasably attachable to a manicuring machine having a drive roller that is insertable into the belt cartridge for engagement of the drive roller with a flexible belt contained in the cartridge, comprising:

a casing having a front wall and a back wall;

a flexible belt contained in the casing, the flexible belt having an abrasive outer surface for shaping fingernails and/or toenails and an inner surface for engaging a drive roller;

a first idler roller or bearing surface mounted in the casing for guiding the flexible belt around a circuitous path;

a second idler roller or bearing surface mounted in the casing for guiding the flexible belt around the circuitous path;

an opening through the back wall of the casing to allow insertion of a drive roller into engagement with the inner surface of the flexible belt; and a first arcuate ridge that projects from an interior surface of the front wall of the casing, and an opposing second arcutate ridge that projects from an interior surface of the back wall of the casing, the opposing first and second arcuate ridges together defining a retainer for holding the flexible belt in close proximity to the circuitous path when a drive roller is not inserted into the casing.

2. The belt cartridge of claim 1, further comprising at least one fastener slot through the back wall of the cartridge, the fastener slot being engageable with a fastener projecting from a cartridge mounting face of a manicuring machine; and wherein the fastener slot has a length greater than needed to allow engagement of the belt with the drive roller, whereby manual tensioning of the belt is achievable by manipulation of the cartridge with respect to the manicuring machine.

* * * * *

UNITED STATES PATENT AND TRADEMARK OFFICE

CERTIFICATE OF CORRECTION

PATENT NO. : 6,799,579 B2
DATED : October 5, 2004
INVENTOR(S) : James R. Joseph

It is certified that error appears in the above-identified patent and that said Letters Patent is hereby corrected as shown below:

Column 2,
Line 34, “bell” should be -- belt --.
Line 47, “easing” should be -- casing --.

Column 3,
Line 50, “IV-IV” should be -- VI-VI --.

Column 6,
Line 37, “arcutate” should be -- arcuate --.

Signed and Sealed this

First Day of February, 2005

JON W. DUDAS
*Director of the United States Patent and Trademark Office*